US008327953B2

(12) United States Patent
Hallundbaek et al.

(10) Patent No.: US 8,327,953 B2
(45) Date of Patent: Dec. 11, 2012

(54) DRILLING TOOL WITH FEED CONTROL

(75) Inventors: Jørgen Hallundbaek, Graested (DK); Thomas Sune Andersen, Helsnigør (DK)

(73) Assignee: Welltec A/S, Allerod (DK)

( * ) Notice: Subject to any disclaimer, the term of this patent is extended or adjusted under 35 U.S.C. 154(b) by 68 days.

(21) Appl. No.: 12/528,217

(22) PCT Filed: Feb. 28, 2008

(86) PCT No.: PCT/DK2008/000083

§ 371 (c)(1),
(2), (4) Date: Aug. 21, 2009

(87) PCT Pub. No.: WO2008/104178

PCT Pub. Date: Sep. 4, 2008

(65) Prior Publication Data

US 2010/0319907 A1 Dec. 23, 2010

(30) Foreign Application Priority Data

Feb. 28, 2007 (DK) ..... 2007 00303

(51) Int. Cl.
*E21B 4/18* (2006.01)

(52) U.S. Cl. ..... 175/94; 175/97; 175/98; 175/321; 175/325.1

(58) Field of Classification Search ..... 175/230, 175/321, 325.1, 94, 97, 98; 408/79, 80; 166/242.7
See application file for complete search history.

(56) References Cited

U.S. PATENT DOCUMENTS

| | | | | | |
|---|---|---|---|---|---|
| 2,056,471 | A | * | 10/1936 | Krall | 175/98 |
| 2,197,019 | A | * | 4/1940 | Monroe | 464/19 |
| 3,088,532 | A | | 5/1963 | Kellner | |
| 3,105,561 | A | * | 10/1963 | Kellner | 175/230 |
| 3,180,437 | A | * | 4/1965 | Kellner | 175/230 |
| 3,225,843 | A | * | 12/1965 | Ortloff et al. | 175/93 |
| 3,497,019 | A | * | 2/1970 | Ortloff | 175/27 |
| 3,815,692 | A | * | 6/1974 | Varley | 175/65 |
| 4,060,141 | A | * | 11/1977 | Catterfeld | 175/94 |
| 4,212,359 | A | * | 7/1980 | Adcock | 175/26 |
| 5,156,223 | A | * | 10/1992 | Hipp | 175/296 |

FOREIGN PATENT DOCUMENTS

EP 1247936 10/2002

* cited by examiner

*Primary Examiner* — William P Neuder
*Assistant Examiner* — Robert E Fuller
(74) *Attorney, Agent, or Firm* — Cozen O'Connor

(57) ABSTRACT

A drilling tool (1) for drilling downhole, comprising a drilling head (2) in connection with a first portion (18) of the drilling tool, a driving unit (9) for driving the drilling head and the first portion forward in a longitudinal movement while drilling, and a feed control (19) for controlling the longitudinal movement of the drilling head.

20 Claims, 8 Drawing Sheets

DRILLING TOOL WITH FEED CONTROL

PRIORITY CLAIM

This is a U.S. national stage of application No. PCT/DK081000083, filed on Feb. 28, 2008. Priority is claimed on the following application(s): Country: Denmark, Application No.: PA 2007 00303, Filed: Feb. 28, 2007, the content of which is incorporated here by reference.

TECHNICAL FIELD

The present invention relates to a drilling tool for drilling in a formation or the like downhole, comprising a drilling head having a drill bit and a driving unit for driving the drilling head forward in a longitudinal movement while drilling.

BACKGROUND

Drilling tools are used when drilling a well in the subterranean formation. However, drilling may also be performed in an existing well for making a branch well or for reboring a stuck valve. An example of a drilling tool is disclosed in U.S. Pat. No. 3,225,843, which tool is anchored to the formation while drilling in order to transfer as much of the energy available as possible to the drilling process, and thereby gain more drilling power.

The subterranean formation may vary in hardness through the formation. Thus, when drilling in a soft part of the formation, the drilling force need not be as great as when drilling in the hardest part of the formation. While drilling from a soft part of the formation to a harder part of the formation, a drill bit on the drilling head will hit the hard formation which may imply serious damage on the individual cutting edge of the bit.

DESCRIPTION OF THE INVENTION

An aspect of the present invention is, at least partly, to overcome the disadvantages of the drilling tool mentioned above, and to provide an improved drilling tool which again improves the drilling process.

This aspect and the advantages becoming evident from the description below are obtained by a drilling tool for drilling in a drilling direction in a structure, such as a recess, protrusion or edge in completion, above or on a valve or a formation downhole, comprising:

- a drilling head having a drill bit and being in connection with a first portion,
- a driving unit for driving the drilling head and the first portion forward in a longitudinal movement while drilling, and
- a feed control for controlling the longitudinal movement of the drilling head, comprising:
  - a second portion fixedly provided within the tool wherein the first and second portion together form a first fluid chamber, the portions being movable in relation to each other while drilling,
  - a second fluid chamber in fluid connection with the first fluid chamber, and
  - a fluid control means for controlling a rate of fluid passing from one chamber to the other for controlling the longitudinal movement of the drilling head in relation to the drilling tool, wherein the drilling tool further comprises a fixating device for abutment of the tool against the structure or the formation and for fixation of the tool at least in the drilling direction.

By having a feed control in the drilling tool, the drilling process can be controlled so that the drill bit on the drilling head will not hit hard into the formation which implies serious damage on the individual cutting edge of the bit.

Even though the function of the feed control is to slow down the forward moving drilling head if needed, using the feed control does not substantially decrease the drilling efficiency when it is not necessary to slow the drilling down. This is due to the fact that the drilling tool can be constructed so that the drilling head is in direct shaft connection with the driving unit and the feed control can be installed surrounding the shaft.

In one embodiment, the first or the second portion may be a piston sliding within the other portion functioning as a piston housing.

In another embodiment, the feed control may further comprise a return valve for letting fluid from the second fluid chamber back into the first fluid chamber, thereby returning the piston to its initial position when the drilling stops.

In yet another embodiment, the fluid control means may comprise a first toothed means interacting with a second toothed means situated on a shaft in the driving unit when a drop of fluid from the first fluid chamber is picked up by a tooth of the first toothed means which, subsequently, engages with a tooth of the second toothed means, turning to transfer the drop of fluid to the second fluid chamber.

Furthermore, the fluid control means may be a throttle valve for providing a controlled fluid flow from the first fluid chamber to the second fluid chamber.

In addition, the first fluid chamber may have at least one spring means in the first fluid chamber for forcing the piston to return to its initial position when the drilling stops.

In another embodiment, the drilling tool may further comprise at least one outlet in the drilling head for ejecting the fluid for releasing swarfs off the formation and for forcing the released swarfs away from the drilling head.

In yet another embodiment, the drilling head may have at least two drilling arms for providing a rotational drilling process.

Furthermore, the drilling head may have rows with a plurality of drill bits.

In addition, the drilling head may have at least three wheels with bits rotating in relation to one another.

In one embodiment, the fixating device may be movably connected to the drilling head for translation of the drilling head in relation to the fixating device during drilling.

In another embodiment, the fixating device is situated in front of the tool in the drilling direction for abutment of the tool against a structure in front of the tool.

In yet another embodiment, the fixating device has a cylindrical, encircling wall surrounding the drill bit when the drill bit is in its initial position before drilling.

Furthermore, the fixating device may be the wheels of a downhole tractor connected to the tool.

In addition, the fixating device comprises two fastening elements movable to press against the formation in a direction transverse to the drilling direction.

Furthermore, the invention relates to a drilling system for drilling downhole, comprising

- the above-mentioned drilling tool, and
- a driving tool such as a downhole tractor for moving the drilling tool in the well.

BRIEF DESCRIPTION OF THE DRAWINGS

The invention is explained in detail below with reference to the drawings, in which.

The drawings are merely schematic and shown for an illustrative purpose.

DETAILED DESCRIPTION OF THE INVENTION

Figure 1:
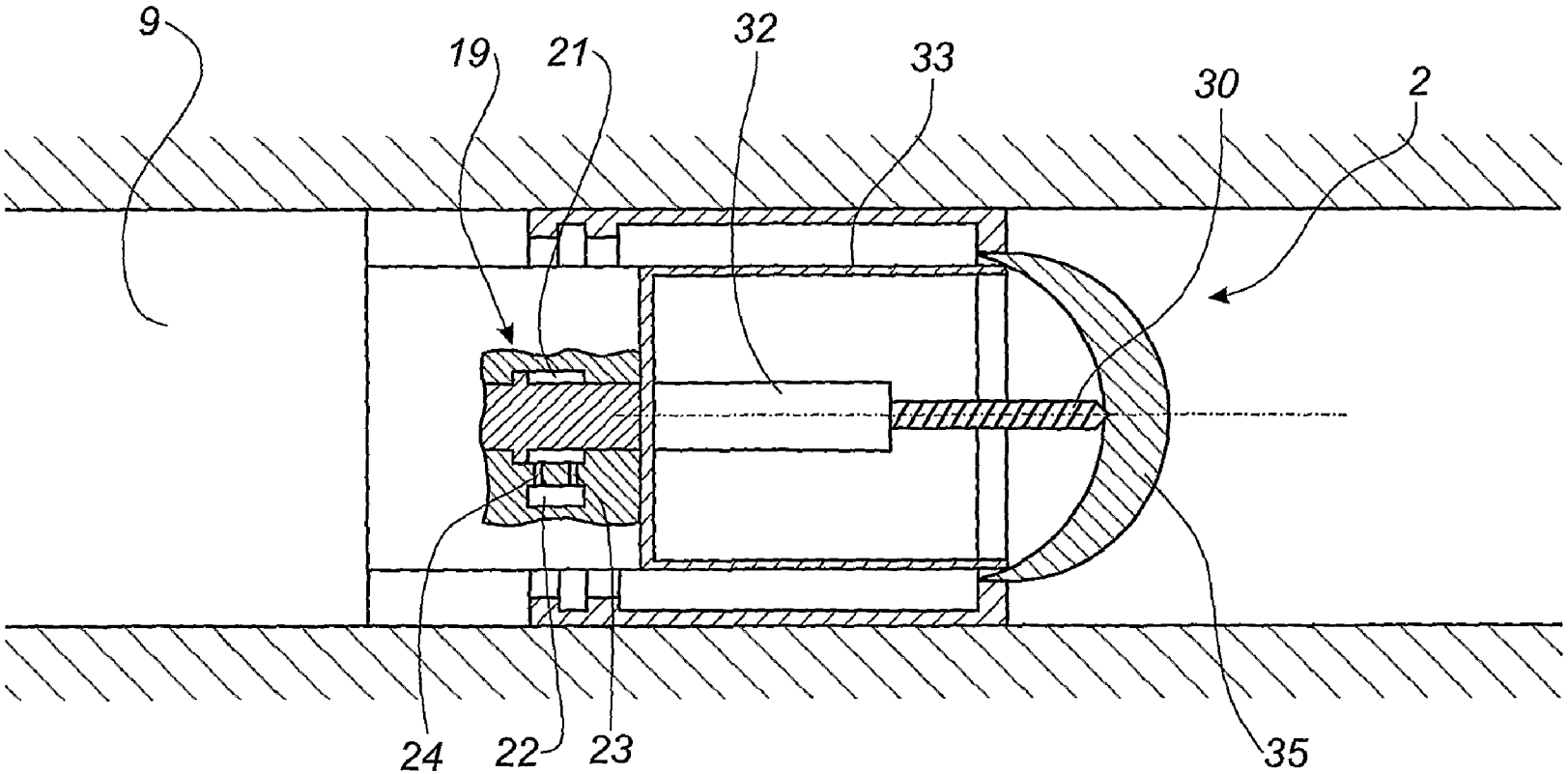
FIG. 1 shows a drilling tool according to the invention with a cross-sectional view of a feed control according to the invention.

FIG. 1 shows a drilling tool 1 according to the present invention comprising a drilling head 2 and a feed control 19. The drilling head 2 is rotationally driven by a driving unit 9 at a certain speed and at a certain weight on bit (WOB) so that the longitudinal displacement of the bit 10 and 30 towards a structure, e.g. a stuck valve 35 (as shown) or a formation 36, is held constant during the drilling process.

The formation 36 may vary in regard to hardness, thereby presenting varying difficulties when drilling. To ensure that the driving unit 9 is able to yield sufficient force to rotate the drilling head 2, the driving unit 9 is constructed to be able to yield a higher force than sufficient for drilling into the hardest part of the formation 36.

By having a feed control 19 controlling the maximum movement of the drilling head 2 in the longitudinal direction of the drilling tool 1 towards the formation 36, it is ensured that the drilling head 2 is driven with the predetermined longitudinal movement. In this way, the drilling head 2 cannot drive faster in the longitudinal direction of the drilling tool 1 than the feed control 19 allows. The cutting edge of the drilling head 2 is thus hindered from hitting hard into a hard formation when drilling from a softer part of the formation 36 to a harder part of the formation 36. Thus, damages on the cutting edge of the drilling head 2 are essentially reduced.

In the embodiment shown in FIG. 1, the drilling head 2 has an elongated drill bit 30 having a fixating device 33 surrounding the drill bit 30. The fixating device 33 fastens the drilling tool 1 in relation to the formation 36 or the stuck valve 35, enabling the feed control 19 to control the movement of the drill 30 bit when drilling in the formation 36 or through a stuck valve 35.

The drilling head 2 is provided on a shaft 32 in connection with a driving unit 9. In this embodiment, the fixating device 33 is situated on the shaft 32 for resting against the inside wall of the stuck valve 35 and for maintaining the drilling tool 1 positioned in relation to that valve during the drilling process. The fixating device 33 is here shown as a cylinder surrounding the drill bit 33. Due to the circumferential shape of the cylindrical fixating device 33, the device 33 is able to guide the drill bit 30 within a curvature, e.g. within a ball house of a ball valve 35 downhole. In this way, the drill bit 30 is forced to abut the curved inside wall of the ball valve 35 and the bit 30 is thus able to drill through the ball valve 35 for reboring the valve 35.

Figure 2:
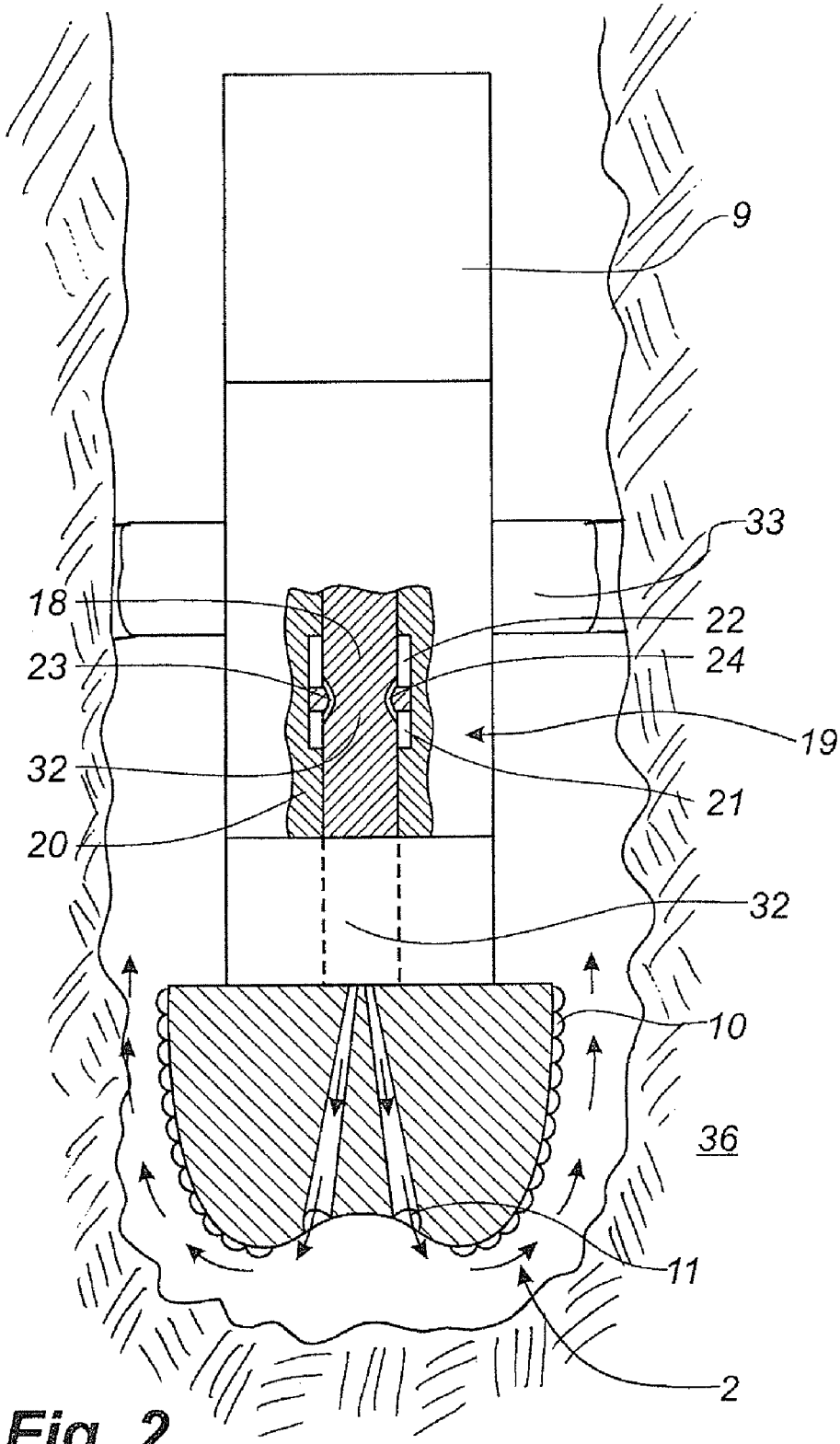
FIG. 2 shows another embodiment of the invention with a cross-sectional view of the feed control.
Figure 3:
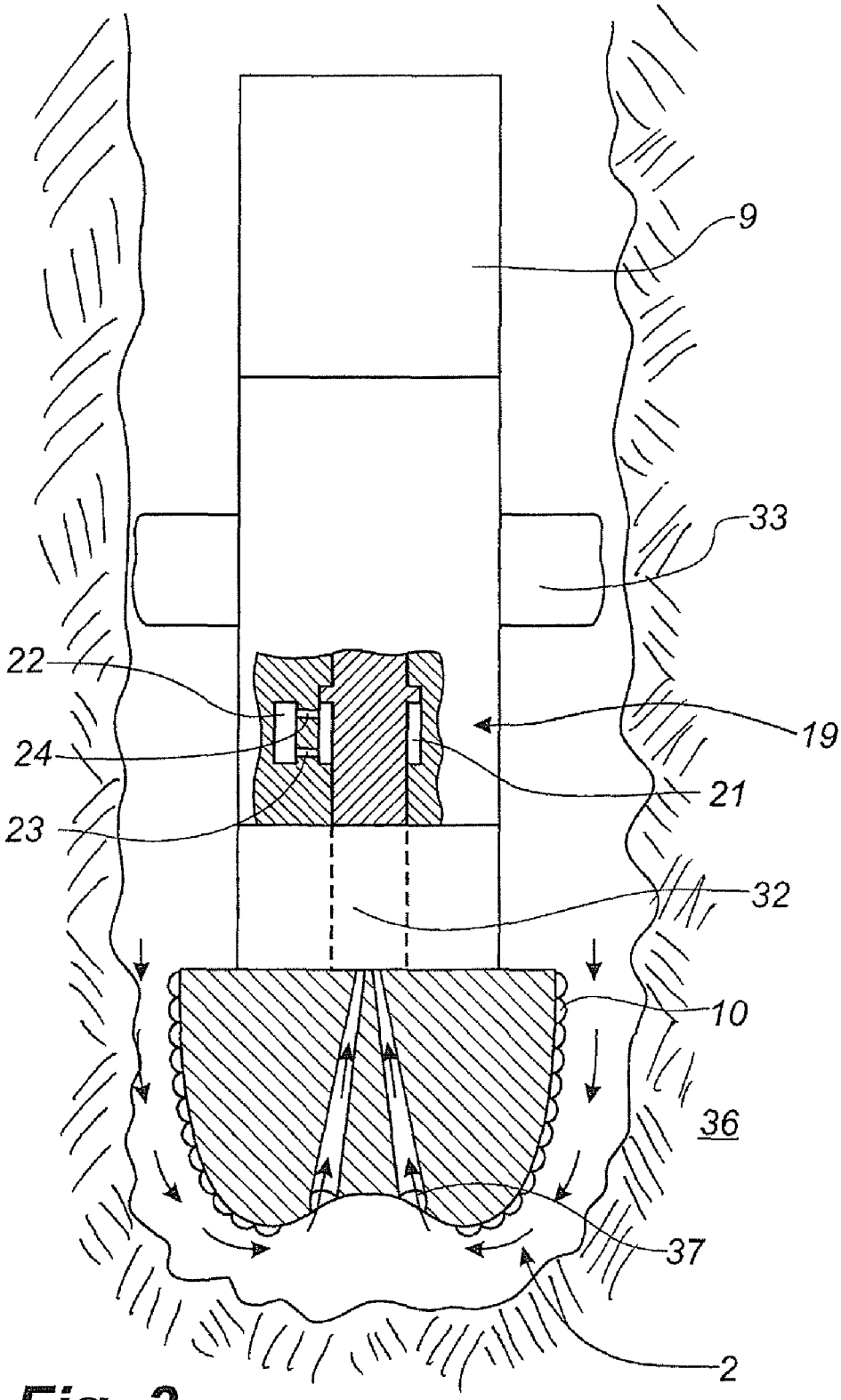
FIG. 3 shows another embodiment of the drilling tool.
Figure 4:
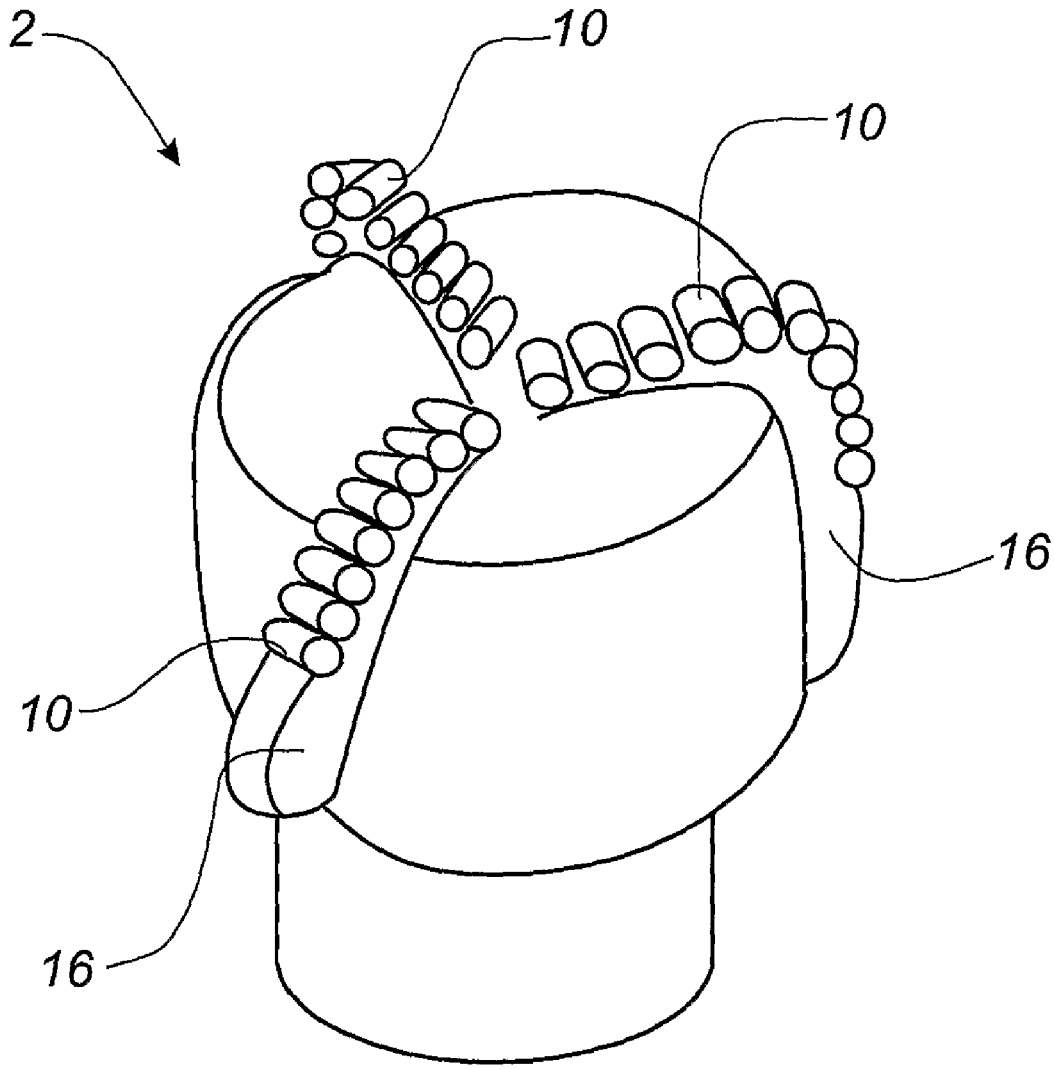
FIG. 4 shows one embodiment of the drilling head.
Figure 5:
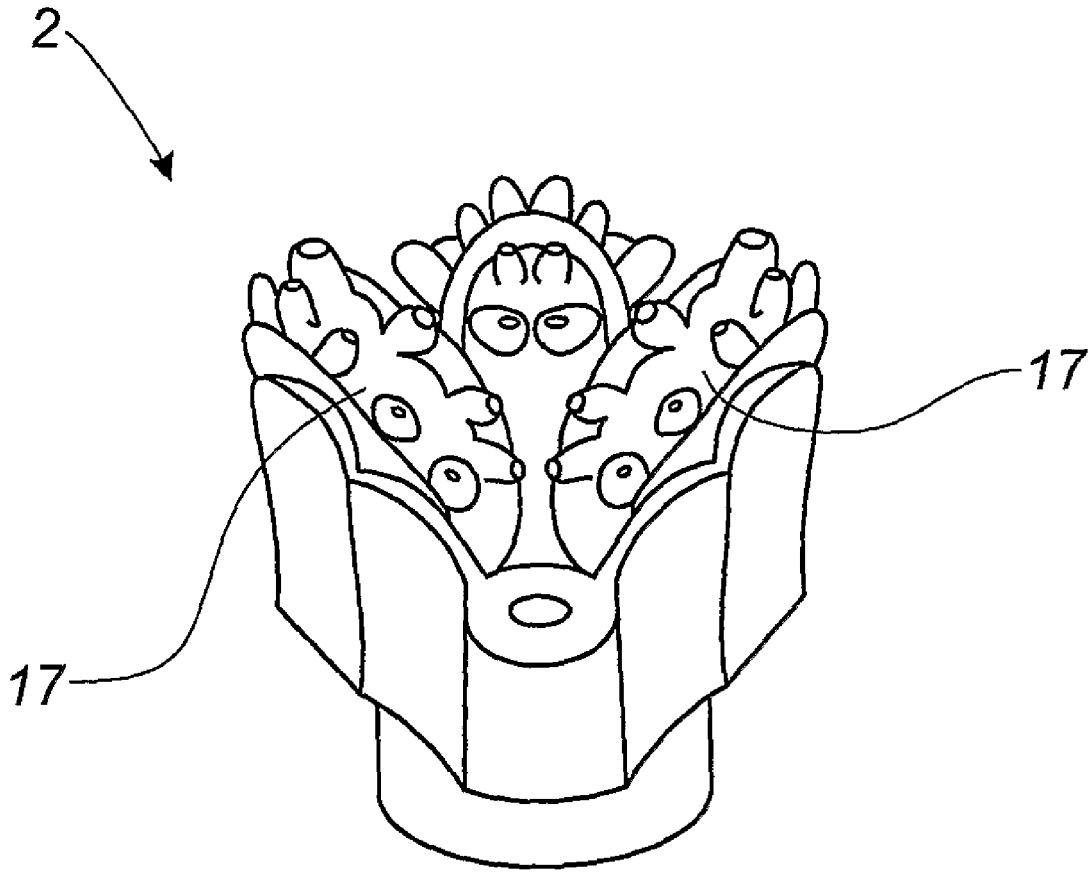
FIG. 5 shows another embodiment of the drilling head.
Figure 6:
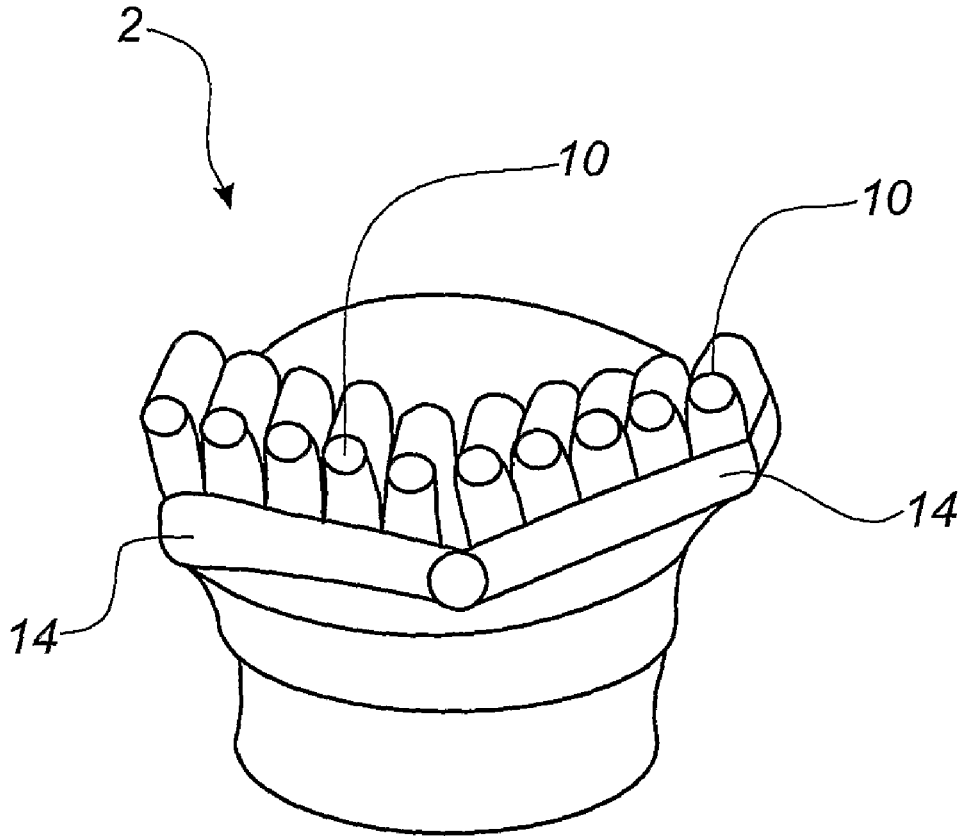
FIG. 6 shows an additional embodiment of the drilling head.

In other embodiments, as shown in FIGS. 2 and 3, the fixating device 33 is in the form of two fastening elements movable in a direction transverse to the drilling direction, thus being able to hold the drilling tool 1 in place during the drilling process. In another embodiment, the fixating device 33 may be the wheels of a downhole tractor connected to the tool.

In FIG. 2, fluid is ejected through outlets 11 in the drilling head in order to release pieces of the formation while drilling and thus to make the drilling operation more efficient. In FIG. 3, fluid is sucked into inlets 37 in the drilling head whereby the drill bits of the drilling head are flushed during the drilling operation.

The feed control 19 of the invention may comprise any suitable control means 23 for controlling the longitudinal displacement of the drilling head 2. In the embodiments of FIGS. 1 and 2, the control means 23 controls the fluid flow from a first chamber 21 to a second chamber 22. While drilling, the drilling head 2 positioned on a first portion 18, 32 of the drilling tool 1 moves longitudinally in relation to a second portion 20 of the drilling tool 1. Together, the first and the second portions 18 and 20 enclose the first fluid chamber 21. The movement of the drilling head 2 in relation to the second portion 20 decreases the volume of the first fluid chamber 21, and the fluid inside the first fluid chamber 21 is thus forced out through the control means 23. The control means 23 controls how much fluid is allowed to flow from the first fluid chamber 21 to the second fluid chamber 22, and the longitudinal drilling movement of the drilling head 2 is in this way controlled.

When the drilling process is terminated, a return valve 24 is opened so that the fluid flows back into the first fluid chamber 21 and, subsequently, the feed control 19 is ready to control the longitudinal drilling motion of the drilling head 2 once again.

Figure 7A:
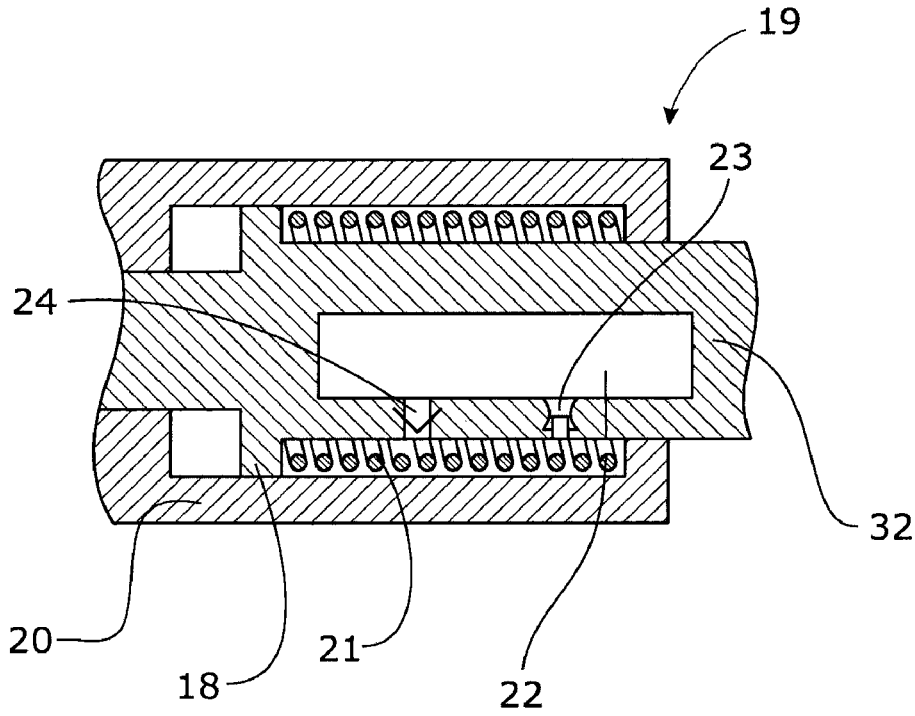
FIG. 7 shows a sectional view of another embodiment of a feed control according to the invention.
FIG. 7*b* shows a sectional view of another embodiment of a feed control according to the invention.
Figure 7B:
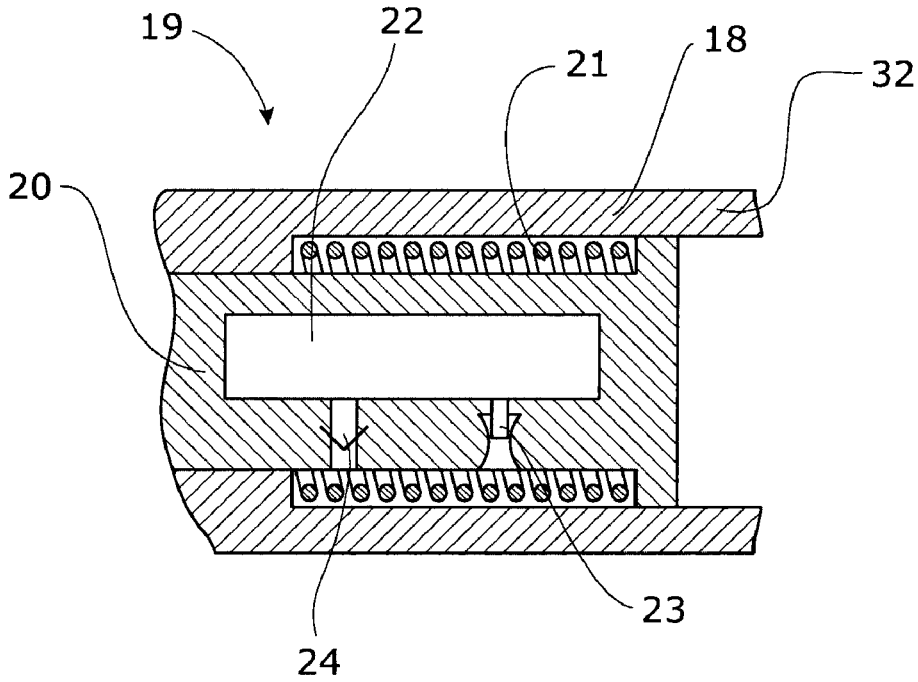
Figure 8:
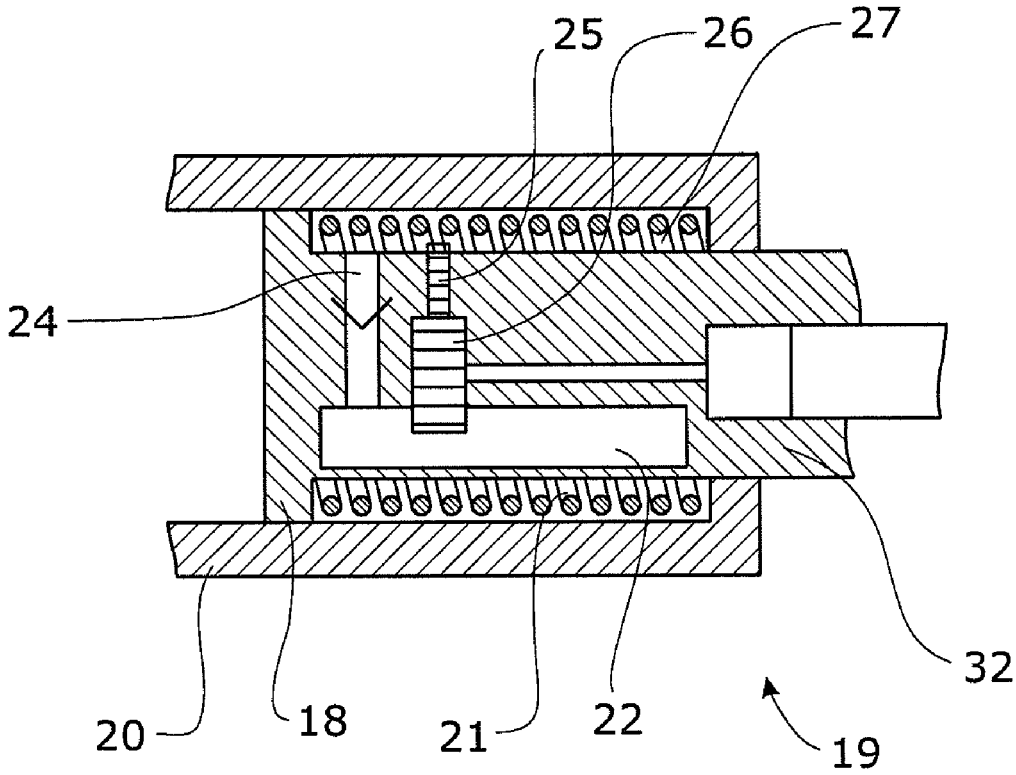
FIG. 8 shows a sectional view of yet another embodiment of the feed control.

In order to force the first portion 18 to return to its initial position, a spring means 27, such as a helically wounded spring, is provided within the first fluid chamber 21 as shown in FIGS. 7 and 8.

In the embodiments of FIGS. 7 and 8, the first portion 18 is a piston sliding within a second portion 20 which is in the form of a piston housing. In another embodiment shown in FIG. 7*b*, the first portion 18 is in the form of a piston housing and the second portion 20 is a slidable piston within that housing.

In FIGS. 1, 2 and 3, the drilling head 2 is situated on a shaft 32 having a collar. The shaft 32 extends through a housing of the feed control 19, the collar thus functioning as a piston within the housing of the feed control 19. In this embodiment, the first portion 18 is a piston on the shaft 32 and the second portion 20 is the piston housing.

As can be seen in FIGS. 7 and 8, the second fluid chamber 22 can be positioned inside a shaft 32 onto which the drilling head is mounted. However as can be seen in FIG. 1, the second fluid chamber 22 may also be positioned in the surrounding structure of the tool. When the fluid chamber 22 is placed in the surrounding structure of the tool, the control means is likewise positioned in the surrounding structure.

Additionally, as can be seen in FIG. 2 the second fluid chamber 22 can be positioned next to the first fluid chamber 21 on the other side of the piston on the shaft 32 and in the same way be enclosed by the first and the second portions 18 and 20. In this embodiment, the control means is positioned in the shaft 32.

In FIGS. 7 and 8, the first fluid chamber 21 is shown as having a circular cross-section; however, in another embodiment, the first fluid chamber 21 may have a square cross-section.

In the embodiment shown in FIG. 7, the feed control 19 has a control means 23 in the form of a throttle valve for letting fluid from a first fluid chamber 21 into a second fluid chamber 22, thereby controlling the longitudinal displacement of the drilling head 2. The throttle valve can either be electrically controllable so as to adjust the fluid flow while drilling, or be manually adjusted before entering the formation downhole.

In FIG. 8, the control means 23 is shown as a first toothed means 25, e.g. a gear wheel or a partly toothed means, engaging with a second toothed means 26. The first toothed means 25 catches a drop while turning in engagement with the second toothed means 26. The drop in the middle of two teeth of the first toothed means 25 is then transferred onto a tooth of the second toothed means 26. By a further rotation of the second toothed means 26, the drop is subsequently transferred into the second fluid chamber 22. In this way, the fluid flow from the first fluid chamber 21 to the second fluid chamber 22 is controlled.

The toothed means 25 and 26 of FIG. 8 are turned by a driving unit 9 rotating the sec- and toothed means 26. However, in another embodiment, the driving unit 9 rotates the first toothed means 25 which again brings the second toothed means 26 to rotate.

In another embodiment of the invention, the feed control 19 comprises a screw and a gear wheel for controlling the longitudinal movement of the drilling head 2. The screw is situated on the shaft 32 in connection with the drilling head 2 and the gear wheel is situated in connection with the driving unit 9.

According to the invention, the drilling head 2 may be any type of drilling head. Some examples are shown in FIG. 1-6. In the embodiment shown in FIG. 4, the drilling head 2 has three rows 16 of bits 10, the head 2 on which the rows 16 are situated rotating in order for the bit 10 to cut swarfs off the formation. In another embodiment shown in FIG. 5, the drilling head 2 has three wheels 17 with a plurality of bits 10, the wheels 17 rotating in relation to one another during drilling. In yet another example of a drilling head 2 shown in FIG. 6, the drilling head 2 has two arms 14 with a plurality of bits 10, the arms 14 rotating while drilling.

The above-mentioned feed control 19 is able to control the longitudinal movement of any kind of drilling head 2 so that the bits 10 on the head 2 is not damaged when drilling in a formation varying in hardness.

In FIG. 2, the drilling tool 1 has a drilling head 2 with several drill bits 10 and two outlets 11 for ejection of fluid in order to increase the drilling efficiency. The outlets 11 are positioned in the drilling head 2 so that the fluid is ejected in order to tear off swarfs from the formation and flush the swarfs away from the drilling head 2. Furthermore, the tool 2 comprises a pump driven by the driving unit 9 for injection of the fluid.

In this embodiment, the driving unit 9 is an electrical motor which drives both the pump and the drilling head 2. The motor has a shaft 32 which drives the pump and the drilling head 2. The shaft 32 is connected to the drilling head 2 through a gear connection. In this way, one drilling head 2 may be replaced by another drilling head 2.

In the event that the drilling tool 1 is not submergible all the way into the casing, a downhole tractor can be used to push the drilling tool 1 all the way into position in the well. A downhole tractor is any kind of driving tool capable of pushing or pulling tools in a well downhole, such as a Well Tractor®.

The invention claimed is:

1. A downhole drilling tool for drilling in a drilling direction in a downhole valve or a formation downhole, comprising:

a drilling head having at least one drill bit and being in connection with a first portion of the tool, a driving unit for driving the drilling head and the first portion forward in a longitudinal movement while drilling, the driving unit being in connection with a second portion of the tool, and a fixating device in connection with the second portion for abutment of the tool against the downhole valve or the formation downhole and for fixation of the tool when drilling, wherein the tool further comprises a feed control inside the tool for controlling the longitudinal movement of the drilling head in the downhole valve or the formation downhole by controlling a movement of the first portion in relation to the second portion of the tool, wherein the feed control comprises:

the second portion fixedly provided within the tool wherein the first and second portion together form a first fluid chamber, a second fluid chamber in fluid connection with the first fluid chamber, and a fluid control means for controlling a rate of fluid passing from one chamber to the other for controlling the longitudinal movement of the drilling head in relation to the drilling tool, wherein the fixating device is situated in front of the tool in the drilling direction for abutment of the tool against the downhole valve in front of the tool or the formation downhole in front of the tool.

2. The downhole drilling tool according to claim 1, wherein the first or the second portion is a piston sliding within the other portion functioning as a piston housing.

3. The downhole drilling tool according to claim 2, wherein the feed control further comprises a return valve for letting fluid from the second fluid chamber back into the first fluid chamber, thereby returning the piston to its initial position when the drilling stops.

4. The downhole drilling tool according to claim 2, wherein the first fluid chamber has at least one spring means in the first fluid chamber for forcing the piston to return to its initial position when the drilling stops.

5. The downhole drilling tool according to claim 2, wherein the fluid control means are inside the piston housing.

6. The downhole drilling tool according to claim 1, wherein the fluid control means is a throttle valve for providing a controlled fluid flow from the first fluid chamber to the second fluid chamber.

7. The downhole drilling tool according to claim 1, wherein the fixating device has a cylindrical, encircling wall surrounding the drill bit when the drill bit is in its initial position before drilling.

8. A downhole drilling tool for drilling in a drilling direction in a downhole valve or a formation downhole, comprising:

a drilling head having at least one drill bit and being in connection with a first portion of the tool, a driving unit for driving the drilling head and the first portion forward in a longitudinal movement while drilling, the driving unit being in connection with a second portion of the tool, and a fixating device in connection with the second portion for abutment of the tool against the downhole valve or the formation downhole and for fixation of the tool when drilling, wherein the tool further comprises a feed control inside the tool for controlling the longitudinal movement of the drilling head in the downhole valve or the formation downhole by controlling a movement of the first portion in relation to the second portion of the tool, wherein the feed control comprises:

the second portion fixedly provided within the tool wherein the first and second portion together form a first fluid chamber, a second fluid chamber in fluid connection with the first fluid chamber, and a fluid control means for controlling a rate of fluid passing from one chamber to the other for controlling the longitudinal movement of the drilling head in relation to the drilling tool, wherein the fixating device has a cylindrical, encircling wall surrounding the drill bit when the drill bit is in its initial position before drilling.

9. The downhole drilling tool according to claim 8, wherein the first or the second portion is a piston sliding within the other portion functioning as a piston housing.

10. The downhole drilling tool according to claim 9, wherein the fluid control means are inside the piston housing.

11. The downhole drilling tool according to claim 8, wherein the feed control further comprises a return valve for letting fluid from the second fluid chamber back into the first fluid chamber, thereby returning the piston to its initial position when the drilling stops.

12. The downhole drilling tool according to claim 8, wherein the fluid control means is a throttle valve for providing a controlled fluid flow from the first fluid chamber to the second fluid chamber.

13. The downhole drilling tool according to claim 8, wherein the first fluid chamber has at least one spring means in the first fluid chamber for forcing the piston to return to its initial position when the drilling stops.

14. The downhole drilling tool according to claim 8, wherein the fixating device is situated in front of the tool in the drilling direction for abutment of the tool against the surroundings in front of the tool.

15. A downhole drilling tool for drilling in a drilling direction in a downhole valve or a formation downhole, comprising:

a drilling head having at least one drill bit and being in connection with a first portion of the tool, a driving unit for driving the drilling head and the first portion forward in a longitudinal movement while drilling, the driving unit being in connection with a second portion of the tool, and a fixating device in connection with the second portion for abutment of the tool against the downhole valve or the formation downhole and for fixation of the tool when drilling, wherein the tool further comprises a feed control inside the tool for controlling the longitudinal movement of the drilling head in the downhole valve or the formation downhole by controlling a movement of the first portion in relation to the second portion of the tool, wherein the feed control comprises:

the second portion fixedly provided within the tool wherein the first and second portion together form a first fluid chamber, a second fluid chamber in fluid connection with the first fluid chamber, and a fluid control means for controlling a rate of fluid passing from one chamber to the other for controlling the longitudinal movement of the drilling head in relation to the drilling tool;

wherein the first or the second portion is a piston sliding within the other portion functioning as a piston housing, and wherein the fluid control means are inside the piston housing.

16. The downhole drilling tool according to claim 15, wherein the feed control further comprises a return valve for letting fluid from the second fluid chamber back into the first fluid chamber, thereby returning the piston to its initial position when the drilling stops.

17. The downhole drilling tool according to claim 16, wherein the first fluid chamber has at least one spring means in the first fluid chamber for forcing the piston to return to its initial position when the drilling stops.

18. The downhole drilling tool according to claim 15, wherein the fluid control means is a throttle valve for providing a controlled fluid flow from the first fluid chamber to the second fluid chamber.

19. The downhole drilling tool according to claim 15, wherein the fixating device is situated in front of the tool in the drilling direction for abutment of the tool against the surroundings in front of the tool.

20. The downhole drilling tool according to claim 15, wherein the fixating device has a cylindrical, encircling wall surrounding the drill bit when the drill bit is in its initial position before drilling.

* * * * *